US008424818B2

(12) United States Patent
Oksnevad et al.

(10) Patent No.: US 8,424,818 B2
(45) Date of Patent: Apr. 23, 2013

(54) BOAT INSTALLATION FRAME FOR TRANSPORTATION TANKS

(75) Inventors: Kjell Magne Oksnevad, Sandnes (NO); Jan Thore Eia, Kvernaland (NO)

(73) Assignee: M-I L.L.C., Houston, TX (US)

( * ) Notice: Subject to any disclaimer, the term of this patent is extended or adjusted under 35 U.S.C. 154(b) by 274 days.

(21) Appl. No.: 12/739,533

(22) PCT Filed: Oct. 21, 2008

(86) PCT No.: PCT/US2008/080608

§ 371 (c)(1), (2), (4) Date: Apr. 23, 2010

(87) PCT Pub. No.: WO2009/055367

PCT Pub. Date: Apr. 30, 2009

(65) Prior Publication Data

US 2010/0224748 A1 Sep. 9, 2010

Related U.S. Application Data

(60) Provisional application No. 60/982,305, filed on Oct. 24, 2007.

(51) Int. Cl.
*A47G 23/02* (2006.01)

(52) U.S. Cl.
USPC ..... 248/146; 137/613; 414/498; 248/147

(58) Field of Classification Search ..... 175/66, 175/206, 207; 138/118, 117.7, 103, 110, 138/177, 155; 414/137.1, 137.9, 498, 349; 166/305.1; 248/220.21, 220.22, 228.1, 544, 248/672, 674, 223.31, 224.7, 313, 146, 147, 248/151, 154; 137/613, 488
See application file for complete search history.

(56) References Cited

U.S. PATENT DOCUMENTS

| | | | | |
|---|---|---|---|---|
| 6,345,672 | B1 * | 2/2002 | Dietzen | 175/66 |
| 6,698,989 | B2 | 3/2004 | Snowdon | |
| 6,702,539 | B2 | 3/2004 | Snowdon | |
| 6,709,216 | B2 * | 3/2004 | Snowdon | 414/137.1 |

(Continued)

FOREIGN PATENT DOCUMENTS

| | | | |
|---|---|---|---|
| DE | 3524723 | A1 | 1/1987 |
| GB | 2430451 | A | 3/2007 |

OTHER PUBLICATIONS

Notification of Transmittal of the International Search Report and the Written Opinion of the International Searching Authority, or the Declaration; Dated Mar. 3, 2011 (11 pages).
Official Action issued in corresponding Canadian Application No. 2,703,097; Dated Sep. 12, 2011 (2 pages).

(Continued)

*Primary Examiner* — Tan Le
(74) *Attorney, Agent, or Firm* — Osha Liang LLP

(57) ABSTRACT

A system to secure a storage unit on a supply vessel surface includes a first frame module having a first attachment mechanism configured to releasably engage with a second attachment mechanism of a second frame module, and a first valve disposed on the first frame module, wherein the first valve is in fluid communication with a second valve disposed on the second frame module through a central flow pipe. The system further includes a locking mechanism configured to releasably secure the storage unit to at least the first frame module, and at least one flow conduit configured to provide fluid communication between the first valve and the storage unit.

18 Claims, 9 Drawing Sheets

U.S. PATENT DOCUMENTS

| | | | | |
|---|---|---|---|---|
| 2002/0074269 | A1* | 6/2002 | Hensley et al. | 175/206 |
| 2003/0190199 | A1 | 10/2003 | Snowdon | |
| 2005/0183574 | A1* | 8/2005 | Burnett et al. | 95/271 |
| 2010/0224748 | A1* | 9/2010 | Oksnevad et al. | 248/220.21 |
| 2010/0319921 | A1* | 12/2010 | Eia et al. | 166/305.1 |
| 2011/0147087 | A1* | 6/2011 | Eia | 175/66 |

OTHER PUBLICATIONS

Office Action issued in corresponding Eurasian Application No. 201070515 with English language communication reporting the same; Dated Dec. 4, 2012 (4 pages).

* cited by examiner

BOAT INSTALLATION FRAME FOR TRANSPORTATION TANKS

BACKGROUND OF DISCLOSURE

1. Field of the Disclosure

Embodiments of the present disclosure generally relate to an apparatus and method to lift and secure equipment to the surface of a supply vessel deck. More specifically, embodiments of the present disclosure relate to an apparatus and method to install, secure, and fill material storage units on a supply vessel deck.

2. Background Art

In the drilling of wells, a drill bit is used to dig many thousands of feet into the earth's crust. Oil rigs typically employ a derrick that extends above the well drilling platform or deck. The derrick supports joint after joint of drill pipe connected end-to-end during the drilling operation. As the drill bit is pushed further into the earth, additional pipe joints are added to the ever lengthening "string" or "drill string". Therefore, the drill string typically includes a plurality of joints of pipe.

Fluid "drilling mud" is pumped from the well drilling platform, through the drill string, and to a drill bit supported at the lower or distal end of the drill string. The drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the platform, it is contaminated with small pieces of shale and rock that are known in the industry as well cuttings or drill cuttings. Once the drill cuttings, drilling mud, and other waste reach the platform, a "shale shaker" is typically used to remove the drilling mud from the drill cuttings so that the drilling mud may be reused. The remaining drill cuttings, waste, and residual drilling mud are then transferred to a holding trough or vessel for disposal. The drill cuttings are typically stored in large tanks or vessels on the drilling rig platform. These vessels may be large in size, and therefore, may require large spaces on the drilling rig. In some situations, for example with specific types of drilling mud, the drilling mud may not be reused and it must also be disposed. Typically, the non-recycled drilling mud is disposed of separate from the drill cuttings and other waste by transporting the drilling mud via a vessel to a disposal site.

The disposal of the drill cuttings and drilling mud is a complex environmental problem. Drill cuttings contain not only the residual drilling mud product that would contaminate the surrounding environment, but may also contain oil and other waste that is particularly hazardous to the environment, especially when drilling in a marine environment. Traditional methods of disposal include dumping, bucket transport, cumbersome conveyor belts, screw conveyors, and washing techniques that require large amounts of water. Adding water creates additional problems such as added volume, bulk, and transportation. Installing conveyors requires major modification to the rig area and involves extensive installation hours and expense.

Another method of disposal includes returning the drill cuttings, drilling mud, and/or other waste via injection under high pressure into an earth formation. Generally, the injection process involves preparation of a slurry within surface-based equipment and pumping the slurry into a well that extends relatively deep underground into a receiving stratum or adequate formation. Material to be injected back into a formation may be prepared into a slurry acceptable to high pressure pumps used in pumping material down a well. The particles are usually not uniform in size and density, thus making the slurrification process complex. If the slurry is not the correct density, the slurry often plugs circulating pumps. The abrasiveness of the material particles may also abrade or damage the pump impellers causing cracking. Some centrifugal pumps may be used for grinding the injection particles by purposely causing pump cavitations.

In some instances, the cuttings, which are still contaminated with some oil, are transported from a drilling rig to an offshore rig or ashore in the form of a thick heavy paste for injection into an earth formation. Typically, the material is transferred into special skips of about 10 ton capacity which are loaded by crane from the rig onto supply boats. This is a difficult and dangerous operation that may be laborious and expensive.

Further, space on offshore platforms may be limited. In addition to the storage and transfer of cuttings, many additional operations take place on a drilling rig, including tank cleaning, slurrification operations, drilling, chemical treatment operations, raw material storage, mud preparation, mud recycle, mud separations, and many others. Due to the limited space, it is common to modularize these operations and to swap out modules when not needed or when space is needed for the equipment. For example, cuttings containers may be offloaded from the rig to make room for modularized equipment used for tank cleaning operations.

In other drilling operations, cuttings containers may be offloaded from the rig to make room for environmental and/or drilling fluid recycling systems. Such systems may include a number of mixing, flocculating, and storage tanks to clean industrial wastewater produced during drilling or shipping operations. Slurrification systems that may be moved onto a rig are typically large modules that are fully self-contained, receiving cuttings from a drilling rig's fluid/mud recovery system.

The lifting operations required to swap modular systems, as mentioned above, may be difficult, dangerous, and expensive. Additionally, many of these modularized operations are self-contained, and therefore include redundant equipment, such as pumps, valves, and tanks or storage units.

Accordingly, there exists a continuing need for systems and methods for efficiently storing and transporting materials used in drilling operations.

SUMMARY OF THE DISCLOSURE

In one aspect, embodiments of the present disclosure relate to a system to secure a storage unit on a supply vessel surface, the system including a first frame module having a first attachment mechanism configured to releasably engage with a second attachment mechanism of a second frame module and a first valve disposed on the first frame module, wherein the first valve is in fluid communication with a second valve disposed on the second frame module through a central flow pipe. The system also including a locking mechanism configured to releasably secure the storage unit to at least the first frame module and at least one flow conduit configured to provide fluid communication between the first valve and the storage unit.

In another aspect, embodiments of the present disclosure relate to an apparatus to secure a storage unit to a supply vessel surface, the apparatus including a first frame module having a first attachment mechanism configured to releasably connect to a second attachment mechanism of a second frame module, and a locking mechanism configured to releasably secure the storage unit to at least the first frame module, wherein at least the first frame module is configured to be removable.

In another aspect, embodiments of the present disclosure relate to a method to fill a storage unit with a material, the method including attaching the storage unit to a removable frame assembly, locking the storage unit to the removable frame assembly, connecting a flow conduit from the frame assembly to the storage unit, and providing a flow of material between the flow conduit and the storage unit.

Other aspects and advantages will be apparent from the following description and the appended claims.

DETAILED DESCRIPTION

Embodiments of the present disclosure generally relate to apparatus and methods to install and secure equipment on a supply vessel surface. More specifically, embodiments of the present disclosure relate to an apparatus and method to install, secure, and fill material storage units on a supply vessel deck.

Figure 1:
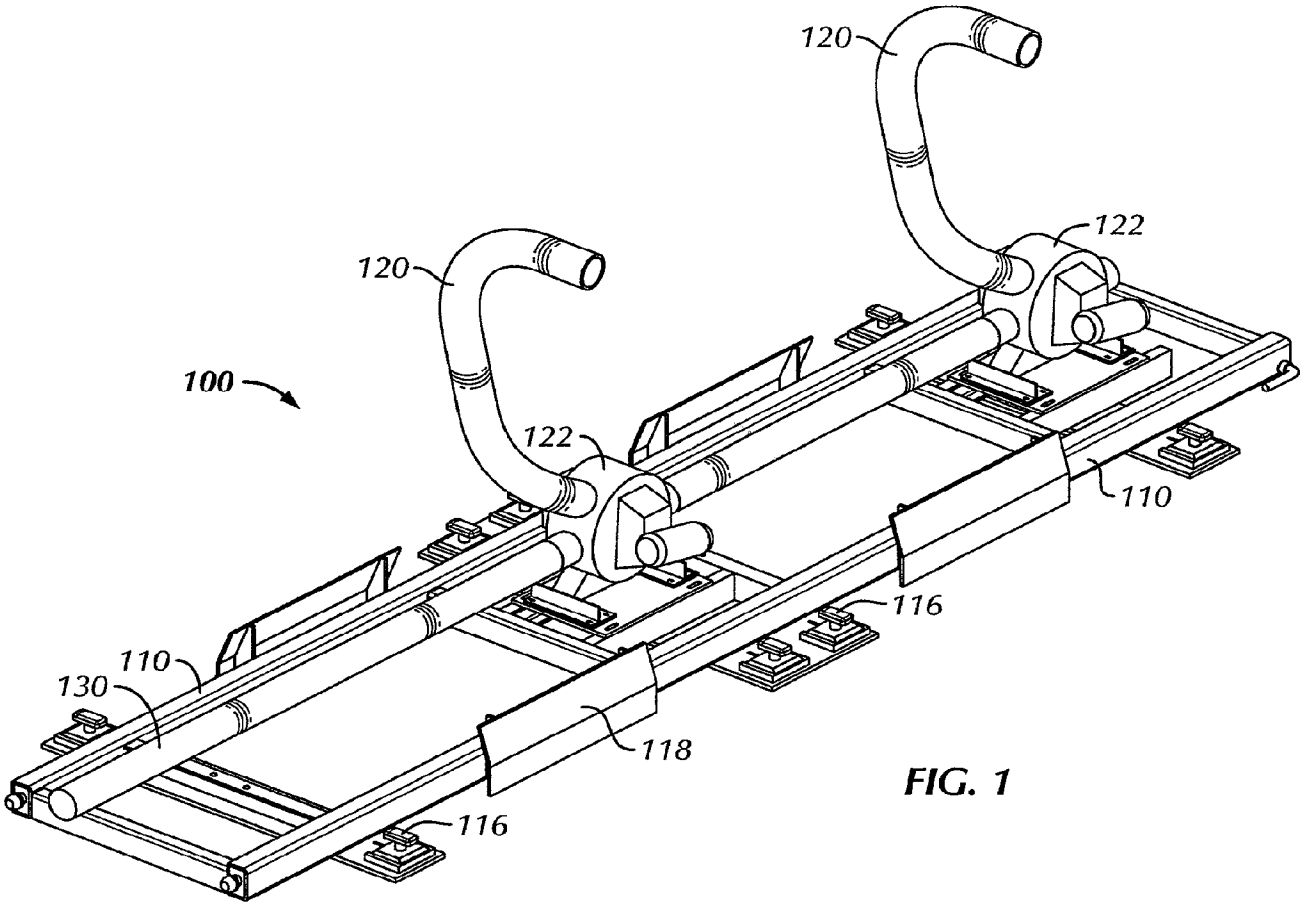
FIG. 1 shows an assembly view of a frame assembly in accordance with embodiments of the present disclosure.

Referring to FIG. 1, a frame assembly 100 for securing storage units on a supply vessel surface in accordance with embodiments of the present disclosure is shown. Frame assembly 100 includes frame modules 110, locking mechanisms 116, and bumper plates 118. Frame assembly 100 also includes valves 122, flow conduits 120, and a main flow pipe 130. Multiple frame modules 110 may be connected via an attachment mechanism (not shown) to form frame assembly 100, which will be discussed in detail below.

Frame modules 110 may be fabricated using various methods known to those skilled in the art. In certain embodiments, frame modules 110 may be fabricated by welding, bolting, riveting, or connecting components in any other way known in the art. Further, materials and configurations of individual components may be varied according to the requirements of a given operation. Example configurations may include steel round tubing, square tubing, I-beams, etc.

Referring still to FIG. 1, various fluid flow equipment may be disposed on frame assembly 100. As illustrated, main flow pipe 130 is mounted on frame module 110, thereby connecting multiple valves 122. Flow conduit 120, extending from valve 122, has a free end 121 configured to connect to storage supply equipment or other required equipment. In one embodiment of the present disclosure, valve 122 may be an R-valve used to divert a flow of material from one storage unit to another. In other embodiments, valve 122 may be any type of valve known to one of ordinary skill in the art, including, but not limited to globe valves, gate valves, butterfly valves, ball valves, etc.

In certain embodiments, valves 122 may be fully automated, and adjust according to fill sensors. Various fill sensors may be used including, but not limited to, level sensors, flow-rate sensors, conductivity sensors, and load-cell sensors. Further, valves 122 may be adjustable as a system, or individually adjustable as single units. Still further, valves 122 may be manually adjusted as seen appropriate by an operator. In alternate embodiments, valves 122 may be configured to divert the flow of material from one storage unit to the next.

Figure 2:
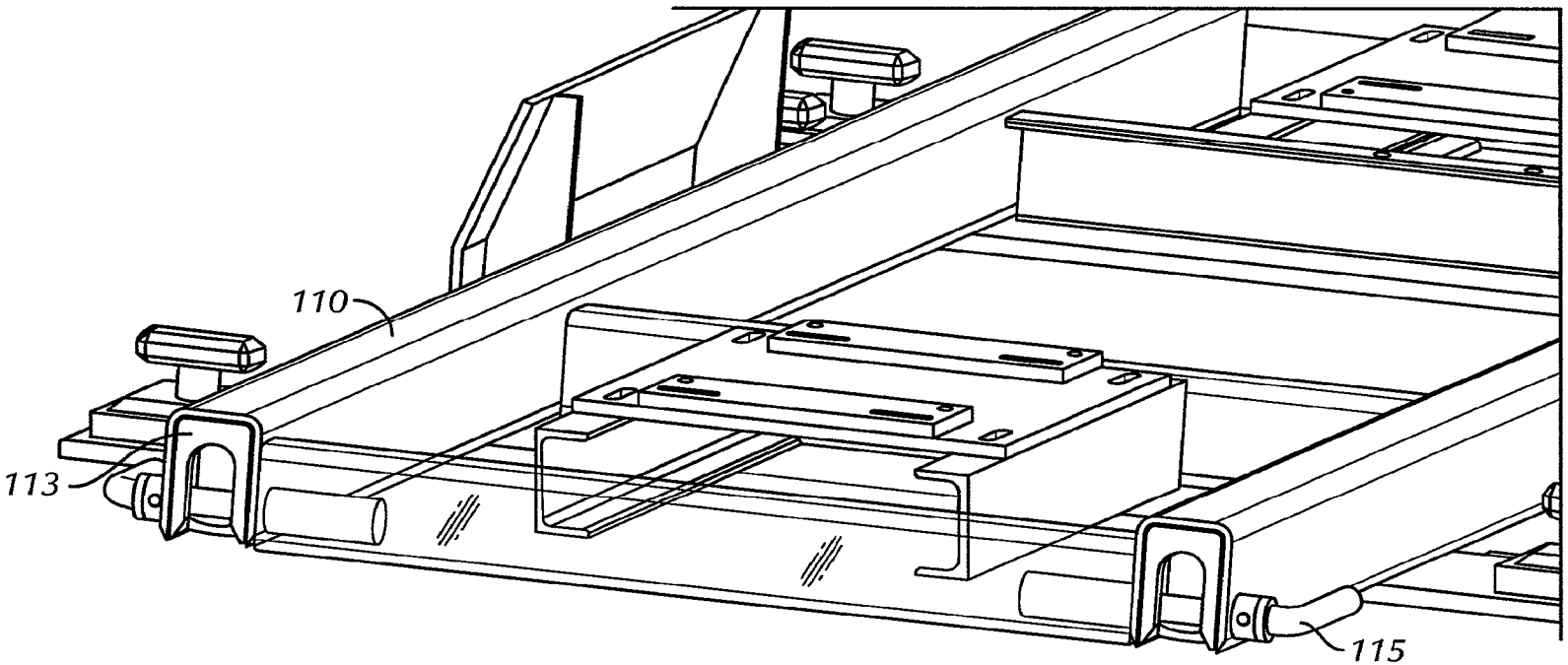
FIG. 2 shows a component view of a female end of a frame assembly in accordance with embodiments of the present disclosure.
Figure 3:
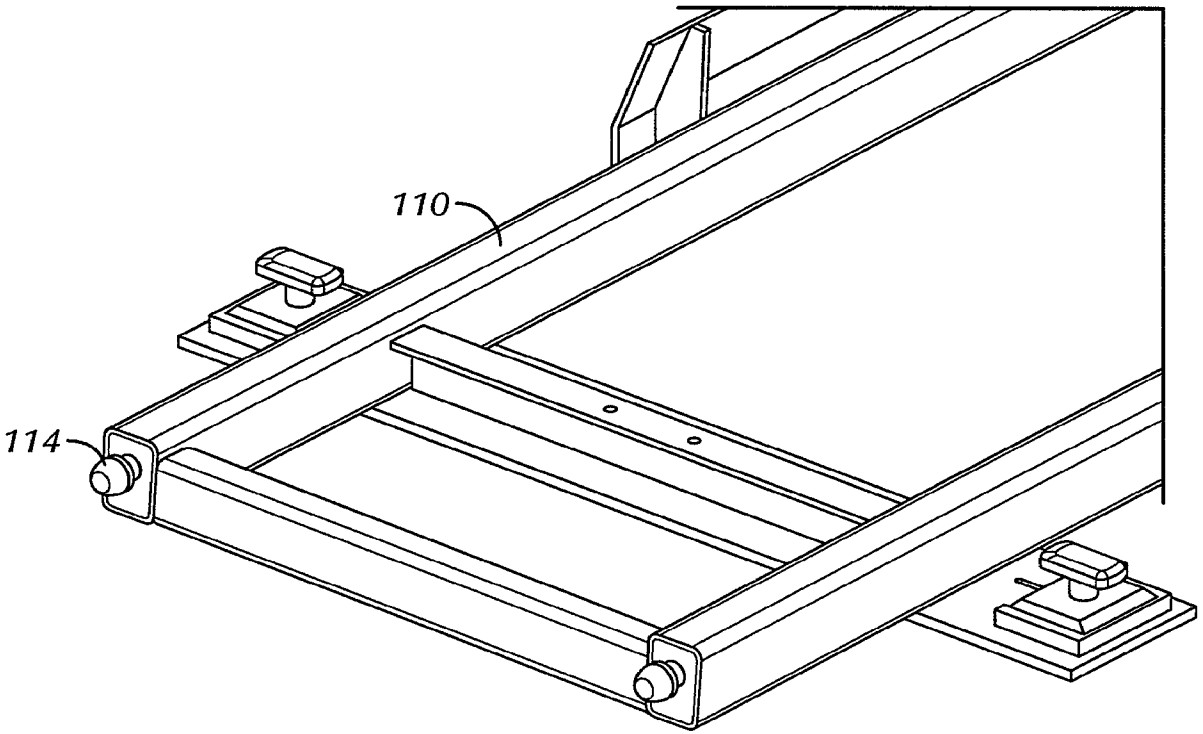
FIG. 3 shows a component view of a male end of a frame assembly in accordance with embodiments of the present disclosure.

Referring to FIGS. 2 and 3 together, a female end 113 and a male guide 114, respectively, of attachment mechanism of frame module 110 are shown in accordance with embodiments of the present disclosure. As shown in FIG. 2, female end 113 of the attachment mechanism includes a locking pin 115. Referring to FIG. 3, a male guide 114 of the attachment mechanism of frame module 110 is shown. Frame modules 110 may include a first end having the female end 113 and an opposite end having the male guide 114. Frame modules 110 may be connected end-to-end by releasably engaging male guide 114 of a first frame module 110 with female end 113 of a second frame module and locking the frame modules together with locking pin 115. While male guide 114 releasably engaged with female end 113 is contemplated, it will be appreciated by one of ordinary skill in the art that alternative means or configurations of connecting frame modules 110 may be used.

In certain embodiments, frame modules 110 may include only female ends 113 on both ends or only male guides 114 on both ends. In such a configuration, frame modules 110 may be arranged so as to alternate having a frame module 110 with females ends 113 connected to a frame module 110 with male guides 114, and continue on in this way alternating with as many frame modules as are required. In further embodiments, attachment mechanisms may includes a sliding lock, ratchet mechanisms, etc.

Figure 4:
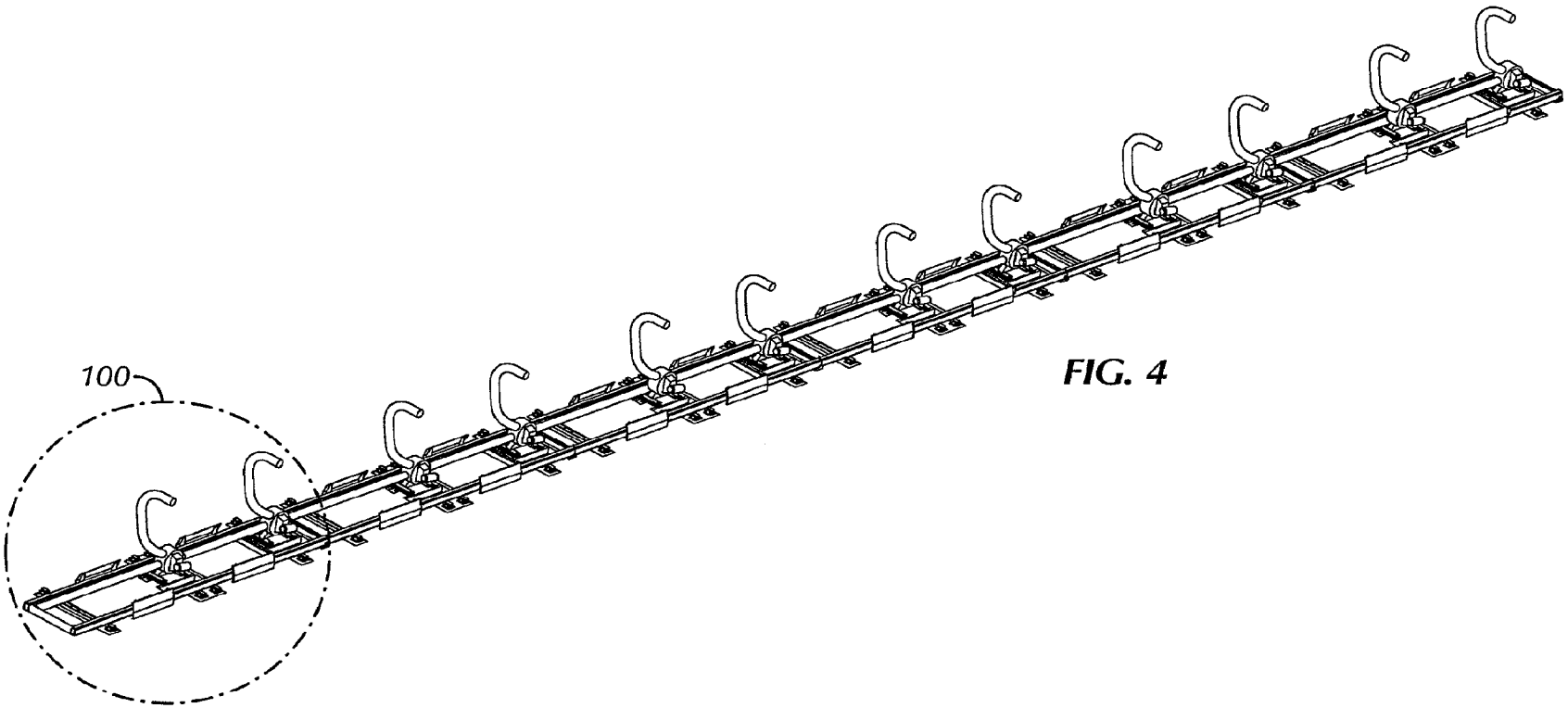
FIG. 4 shows an assembly view of multiple frame assemblies connected in accordance with embodiments of the present disclosure.

Referring now to FIG. 4, a frame assembly 100 in accordance with embodiments of the present disclosure is shown. Multiple frame assemblies 100 (from FIG. 1) are shown fastened end-to-end to form a larger frame assembly capable of connecting multiple storage units as needed. Depending on the size of the supply vessel, or number of storage units needed, a person of ordinary skill in the art will appreciate that any number of frame modules 110 for a required operation may be connected to one another. For example, larger operations may require more storage units or larger storage units to store fluids, which may require more frame assemblies for attachment.

Figure 5:
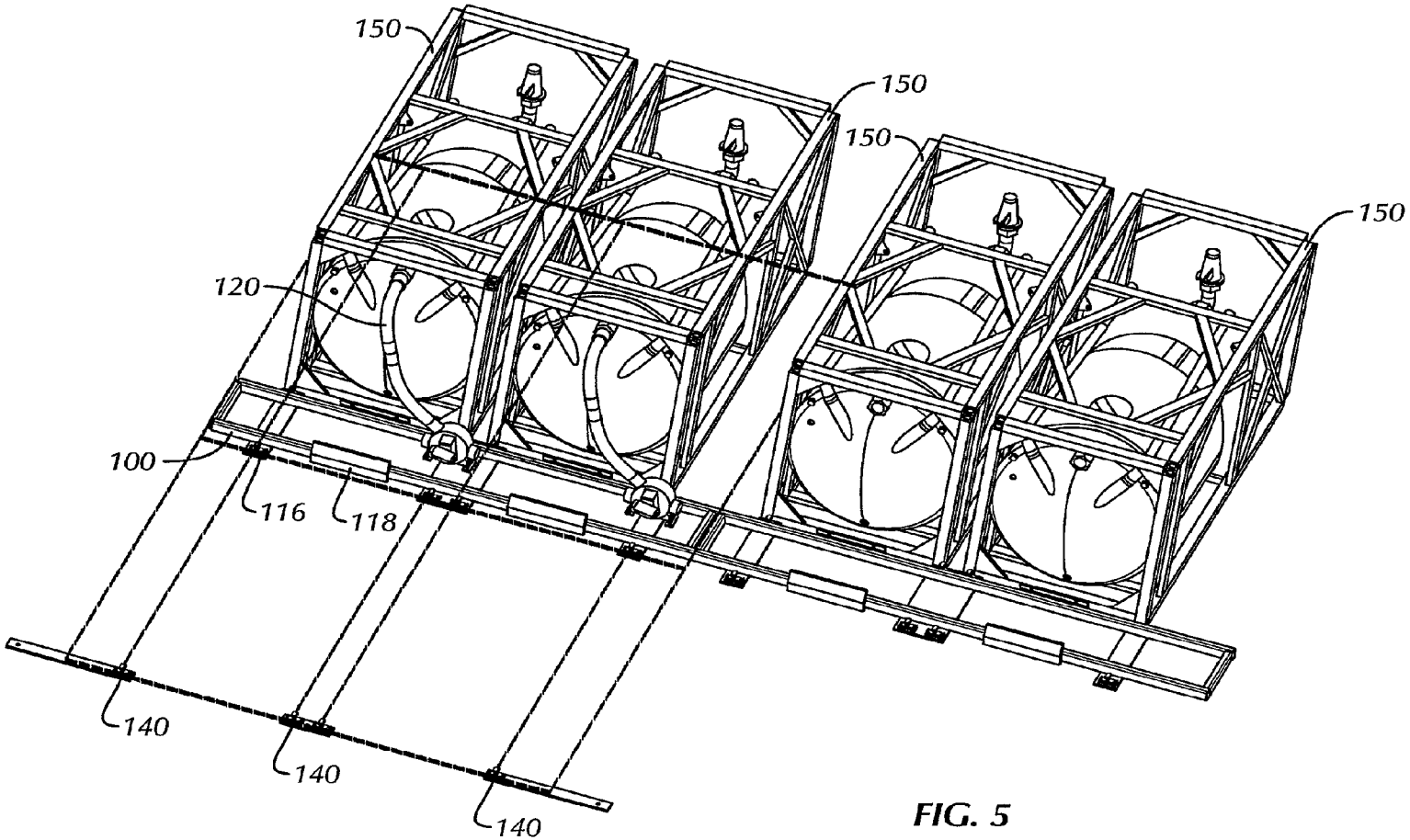
FIG. 5 shows an assembly view of the installation of the storage units onto the frame assembly in accordance with embodiments of the present disclosure.

Now referring to FIG. 5, storage units 150 secured to a frame assembly 100 in accordance with embodiments of the present disclosure are shown. After completing frame assembly 100, attachment straps 140 are measured and secured to storage units 150 providing extra support. Attachment straps 140 may be secured to the frame assembly 100 with any locking device known to a person having ordinary skill in the art, including, but not limited to, bolts, screws, rivets, etc. Storage units 150 are then secured to frame assembly 100 with locking mechanism 116, and flow conduit 120 may be connected to storage unit 150. Locking mechanism 116 may be of any design known to one of ordinary skill in the art, including, but not limited to, automated locks, manual locks, etc. Further, bumper plates 118 are provided to prevent damage to valves 122 and flow conduits 120 when joining storage units 150 with frame assembly 100.

Figure 6:
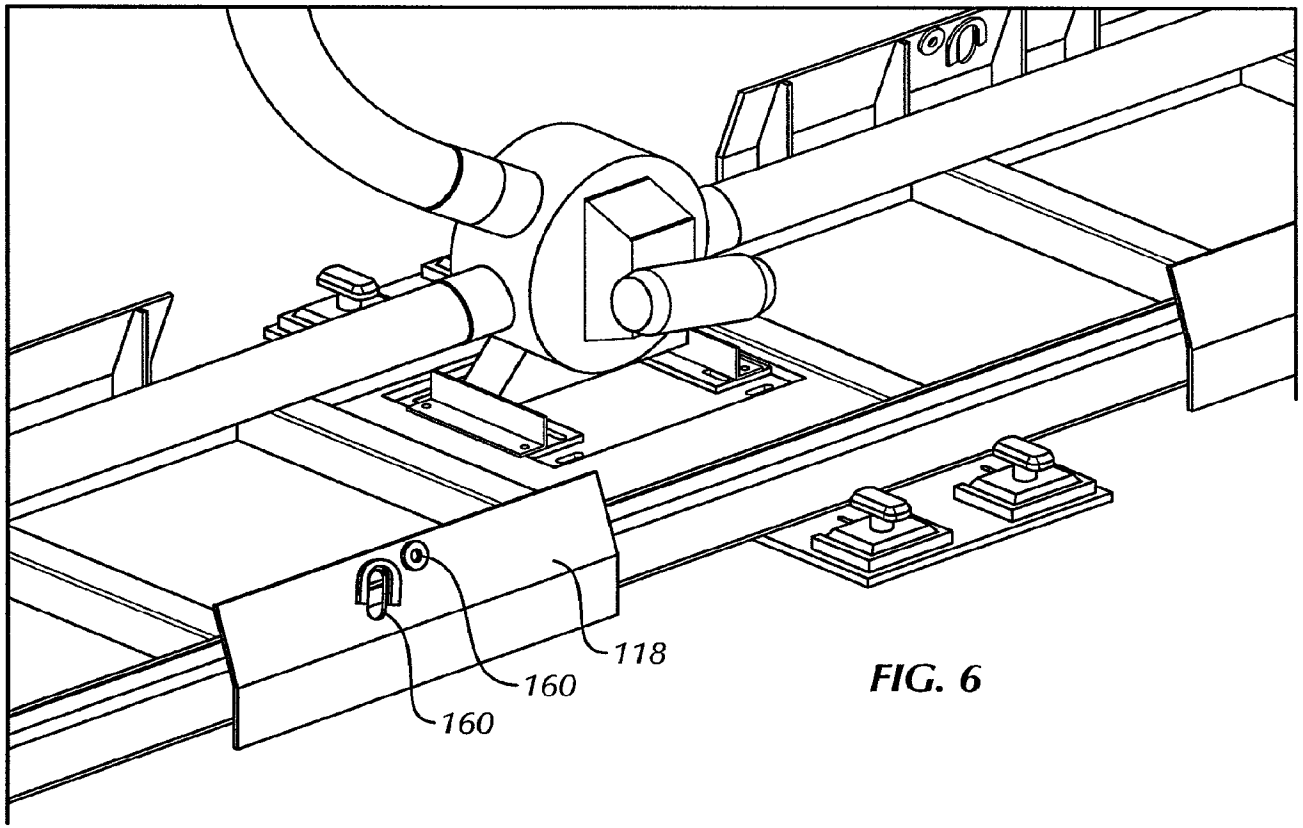
FIG. 6 shows an assembly view of a lifting point on a frame assembly in accordance with embodiments of the present disclosure.

Referring to FIG. 6, lifting points 160 for frame assembly 100 are shown in accordance with embodiments of the present disclosure. Bumper plates 118 may have lifting points 160, such that lifting equipment (e.g., cranes) may be attached. Lifting points may be configured as hook lift holes, shackles, etc., for attaching a hook or wire sling to, such that frame assembly 100 may be removable.

Installation of the frame assembly 100 from FIG. 1 may be performed by lifting the individual frame modules 110 onto a supply vessel deck by inserting a hook (not illustrated) into a lifting point or by connecting a wire sling through a shackle in the frame module 110. Next, frame modules 110 may be attached to one another via an attachment mechanism, wherein a male guide is inserted into a female end and secured in place with a locking pin. Once frame modules 110 are secured together, fluid equipment, including valves, flow conduits, and a main flow pipe, may be attached to the storage units. Attachment straps may be secured to the storage units prior to lifting them onto frame assembly 100 for added support. Finally, the storage units may be secured to the frame assembly with a locking mechanism. In this way, storage units may be arranged and secured to the supply vessel deck.

In one embodiment of the present disclosure, the frame assembly may be configured to secure the storage units on a boat deck surface, offshore rig surface, or land surface. Further, the frame assembly may be configured to allow for filling storage units in multiple positions, including a vertical and horizontal position. To compensate for various positions of the storage units, the flow conduit may be expandable and flexible to provide for the different lengths needed to connect to the storage units at various positions. Flexible flow conduits may also provide for the efficient filling of various sizes of storage units, such as may be used in a single drilling operation.

Figure 7A:
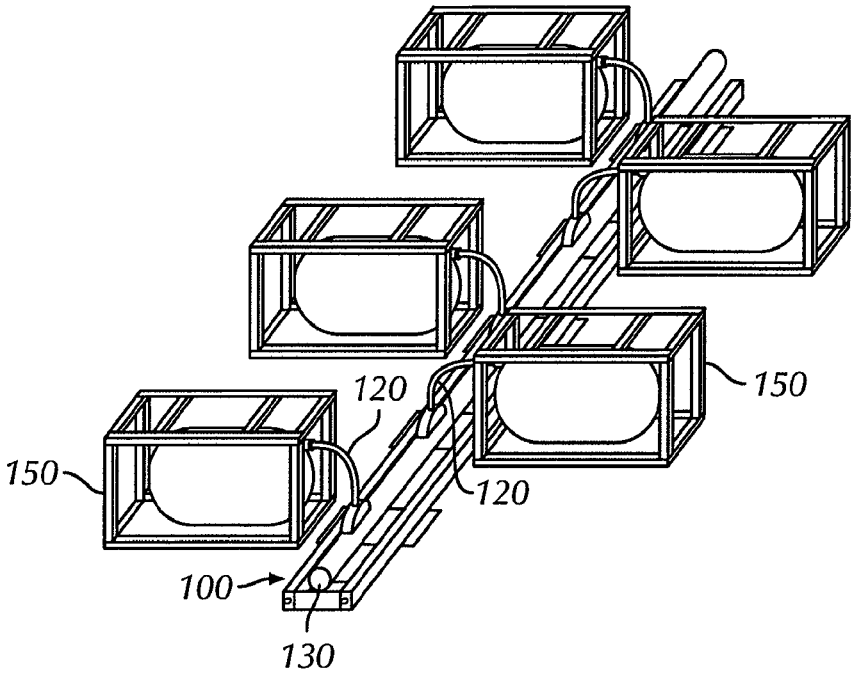
FIG. 7A-7C show system views of various arrangements of storage units and frame assemblies in accordance with embodiments of the present disclosure.
Figure 7B:
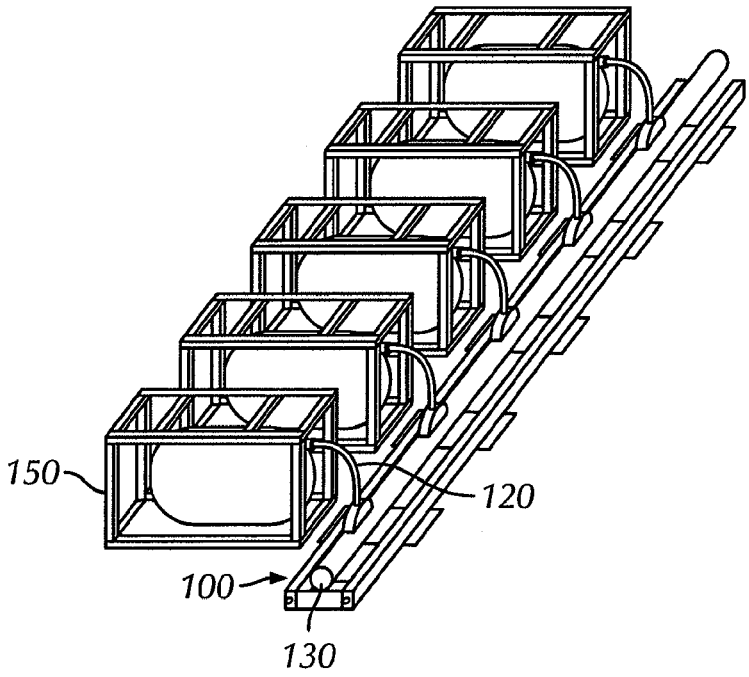
Figure 7C:
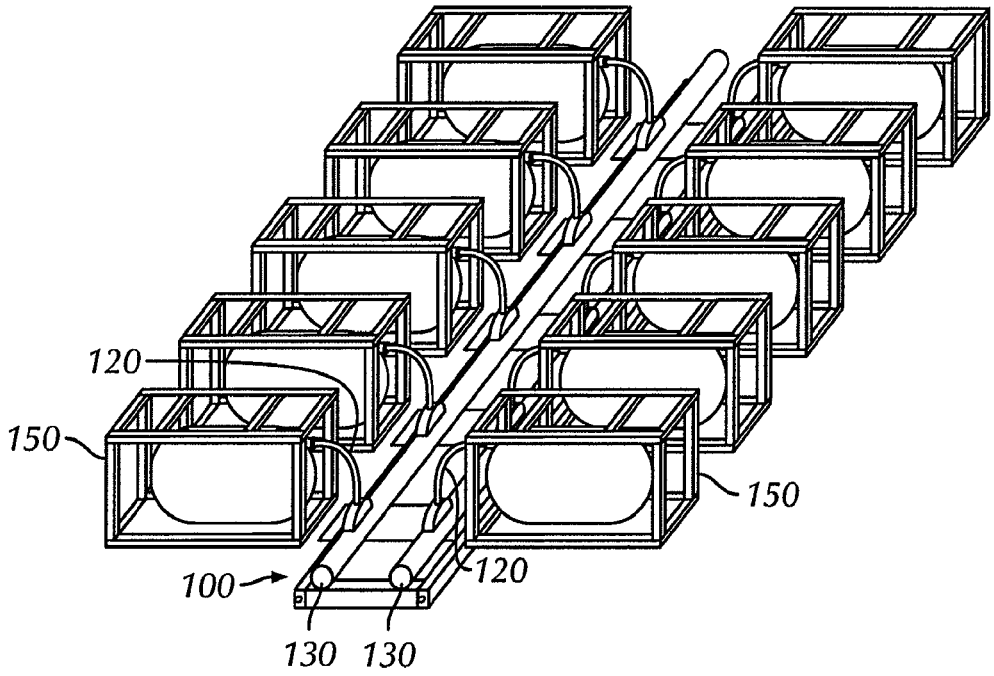

Referring now to FIG. 7A-7C, various arrangements of storage units 150 attached to a frame assembly 100 in accordance with embodiments of the present disclosure are shown. FIG. 7A shows an alternating arrangement of storage units 150 as attached down both sides of frame assembly 100. FIG. 7B shows an arrangement of storage units 150 down a second side of frame assembly 100. In this embodiment, flow conduits 120 have been rotated 180 degrees from their normal position to connect to storage units 150 on the second side. In one embodiment, the flow conduits may be configured to rotate 360 degrees to allow for alternate arrangements and connections to storage units 100. Finally, FIG. 7C shows an alternate embodiment in which two main flow pipes 130 connect to rows of storage units 150 down both sides of the frame assembly 100. Embodiments of various storage unit arrangements may allow for a greater number of storage units 150 to be used at once, as well as to maximize the use of space available on a supply vessel deck. Furthermore, various arrangements may provide solutions to balancing the weight on the deck of a supply vessel once loaded.

Still further, in alternate embodiments of the present disclosure, frame assembly 100 may be configured to attach to the supply vessel surface to further prevent movement of the assembly. "Sea fastening" mechanisms for frame assembly 100 may include pre-existing tie downs on the deck surface, attachment straps, chains, etc. The sea fastening mechanisms may be attached to the storage unit and to the deck surface byway of special hooks or holes on the deck surface of the supply vessel. The added security from the sea fastening mechanisms may be provided for use during rough weather conditions or as otherwise seen appropriate by a person skilled in the art.

Figure 8A:
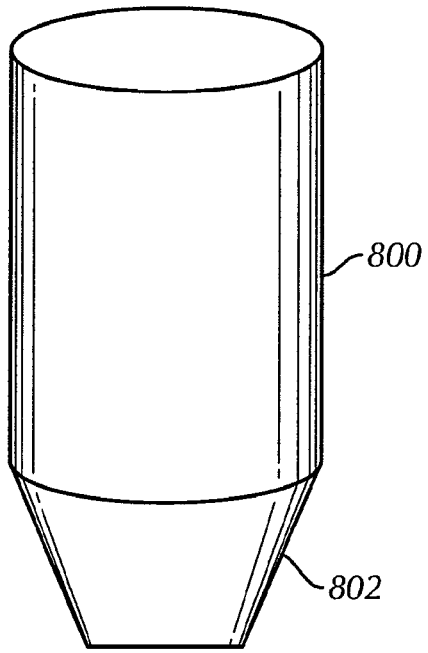
FIG. 8A shows a component view of a pneumatic storage unit.

Embodiments of the present disclosure may also include various configurations for transportation and containment of fluids. Referring to FIG. 8A, in certain embodiments, a pneumatic storage vessel 800 may have an angled lower section 802 configured to achieve mass flow of the material in the pneumatic storage vessel 800. In one embodiment, angled lower section 802 may include one conical angle. An exemplary pneumatic storage vessel 800 is an ISO-PUMP® commercially available from M-I, LLC (Houston, Tex.). Pneumatic storage vessels 800 may be used in the containment and transport of drill cuttings, for example, to provide temporary rig storage of drill cuttings prior to a re-injection operation. Further, pneumatic storage vessels 800 may be used for boat transport and land transport of cuttings, and may then be used to discharge cuttings into the final disposal or recycling process. Pneumatic storage vessel 800 may be a stainless steel pressure vessel housed in a standard ISO-container-sized frame. Discharge of the pneumatic storage vessel is pneumatic, requiring a compressed air supply. To discharge, the vessel is pressurized, an outlet valve (not shown) opened, and the contents discharged. Fluid equipment, including the main flow pipe, flow conduits, and valves may be configured to allow for pneumatic transfer of material as described above.

Figure 8B:
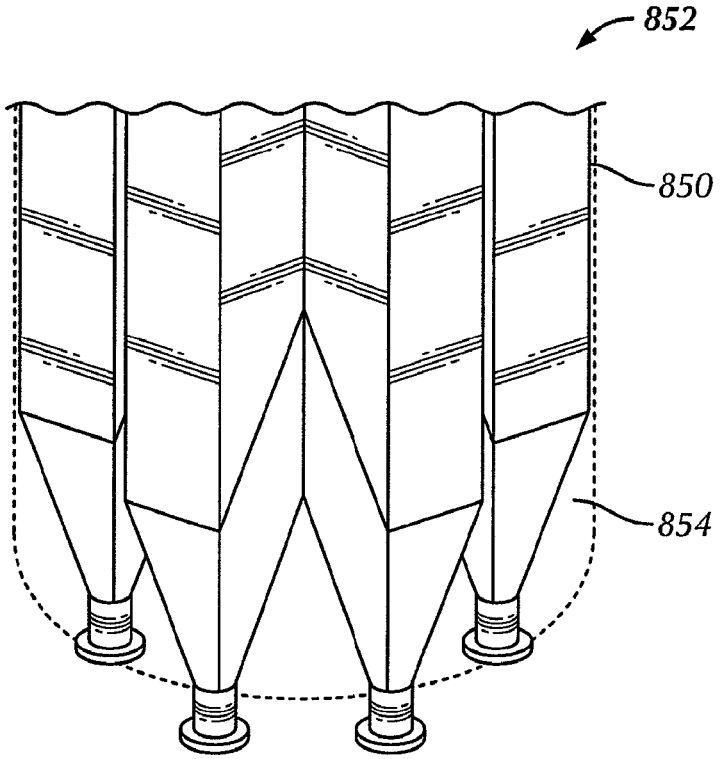
FIG. 8B shows a component view a storage unit having a plurality of internal baffles.

Referring now to FIG. 8B, alternate embodiments may be configured to work with other storage units 850 having various configurations. One such storage unit 850 may have an angled lower section 852 having a plurality of internal baffles 854 for directing a flow of drill solids to a specific one of outlets 856. For example, as drill solids are transferred into storage unit 852, the drill solids may be divided into a plurality of discrete streams, such that a certain volume of drill solids are discharged through each of the plurality of outlets 856. Thus, storage unit 850 having a plurality of baffles 854, each corresponding to one of outlets 856, may increase the efficiency of discharging drill solids from storage unit 850.

To facilitate the transfer of material from the storage units to a supply vessel or between storage units, in one embodiment, the storage unit may be pressurized. In such an embodiment, a pressurized storage unit may store non-free flowing material, for example, cuttings. In this embodiment, a pneumatic transfer device may be coupled to the storage unit. Pneumatic transfer devices may include, for example, a cuttings blower and pneumatic transfer lines, such as those disclosed in U.S. Pat. Nos. 6,698,989, 6,702,539, and 6,709,216, hereby incorporated by reference herein. However, those of ordinary skill in the art will appreciate that other methods for transferring cuttings to storage units may include augers, conveyors, and vacuum suction.

In still further embodiments of the present disclosure, with the frame assembly installed on a drilling rig, the main flow pipe providing fluid communication between all storage units may be connected to a loading hose that is connected to a supply vessel. The supply vessel may have another frame assembly with storage units installed on the surface to receive fluids from the drilling rig, thereby preventing the offloading of storage units from the drilling rig. This may advantageously increase the efficiency and speed at which operations may occur, as well as reduce the risk of spills or injury to personnel from lifting.

The loading hose described above may be connected directly to an end of the main flow pipe, or may be connected via a TILT TABLE (commercially available from M-I, LLC, Houston, Tex.), which is a device which may provide a safer and easier connection method for the loading hose. The TILT TABLE is attached to either side or the stern of a vessel. During connection, a flange of the loading hose is guided onto the TILT TABLE and secured quickly using latching handles, and moved, via a hydraulic jack, to its connection position.

Embodiments of the present disclosure may provide advantages when securing storage units to the deck of a supply vessel. When installing tanks for cuttings or other material on the deck of a supply boat, the installation time may be costly due to welding and transportation of equipment parts that are assembled on the deck. The size of the equipment may require large areas for storage and high maintenance both on the boat and in the yard. Embodiments of the present disclosure may reduce labor intense manual handling of cutting transfer equipment by providing pre-installed frame modules that may be quickly located and attached together.

Furthermore, preinstalled frame modules that may be quickly located and attached together may reduce the manual handling of the frames, thereby reducing risk to personnel on the deck. Further, the attachment mechanism between the frame modules may reduce installation and assembly time, thereby increasing the overall efficiency of a waste management operation. Embodiments of the present disclosure may also help to organize the storage units on the deck of the supply vessel, thereby eliminating wasted space.

Finally, embodiments of the present disclosure may be retrofitted to older equipment or structures, including rigs and supply vessels. Because of the ease with which the frame modules attach together, they may be lifted onto a rig or supply vessel and quickly attached, providing a reliable attachment for storage units. Frame assemblies in accordance with embodiments disclosed herein may also be installed when retrofitting older oil rigs and supply vessels, thereby reducing overall costs.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A system to secure a storage unit on a supply vessel surface, the system comprising:

a first frame module having a first attachment mechanism configured to releasably engage with a second attachment mechanism of a second frame module;

a first valve disposed on the first frame module, wherein the first valve is in fluid communication with a second valve disposed on the second frame module through a central flow pipe;

a locking mechanism configured to releasably secure the storage unit to at least the first frame module; and at least one flow conduit configured to provide fluid communication between the first valve and the storage unit.

2. The system of claim 1, further comprising attachment straps configured to secure the storage unit to a second storage unit.

3. The system of claim 1, further comprising a sea fastening mechanism to releasably secure at least the first frame module to the supply vessel surface.

4. The system of claim 1, wherein the first and second frame modules further comprise a plurality of bumper plates.

5. The system of claim 1, wherein the frame modules comprise lifting points.

6. The system of claim 1, wherein the flow conduit comprises an expandable conduit.

7. The system of claim 1, wherein the flow conduit comprises a flexible conduit.

8. The system of claim 1, wherein the flow conduit rotates at least 180 degrees to allow connection to the supply vessel at various positions.

9. The system of claim 1, wherein the flow conduit rotates 360 degrees to allow connection to the supply vessel at various positions.

10. The system of claim 1, wherein the first attachment mechanism comprises a male guide configured to releasably engage a female end of the second attachment mechanism.

11. The system of claim 10, further comprising a locking pin to prevent disengagement of the first and second attachment mechanisms.

12. The system of claim 1, wherein the storage units comprise pneumatic storage units.

13. The system of claim 1, wherein the storage units are secured in a vertical position.

14. The system of claim 1, wherein the storage units are secured in a horizontal position.

15. An apparatus to secure a storage unit to a supply vessel surface, the apparatus comprising:

a first frame module having a first attachment mechanism configured to releasably connect to a second attachment mechanism of a second frame module;

a locking mechanism configured to releasably secure the storage unit to at least the first frame module;

a first valve disposed on the first frame module, wherein the first valve is configured for fluid communication with a second valve disposed on the second frame module through a main flow pipe; and at least one flow conduit configured to provide fluid communication between the first valve and the storage unit;

wherein at least the first frame module is configured to be removable.

16. The apparatus of claim 15, wherein the flow conduit comprises an expandable conduit.

17. The apparatus of claim 15 wherein the flow conduit comprises a flexible conduit.

18. The apparatus of claim 15, wherein the first and second frame modules further comprise a plurality of bumper plates.

* * * * *